US010472851B1

(12) United States Patent
Brislin

(10) Patent No.: US 10,472,851 B1
(45) Date of Patent: Nov. 12, 2019

(54) FENCE ANCHOR DEVICE

(76) Inventor: Robert J. Brislin, Hazleton, PA (US)

( * ) Notice: Subject to any disclaimer, the term of this patent is extended or adjusted under 35 U.S.C. 154(b) by 0 days.

(21) Appl. No.: 10/421,541

(22) Filed: Apr. 23, 2003

(51) Int. Cl.
*E04H 17/08* (2006.01)

(52) U.S. Cl.
CPC ..... *E04H 17/08* (2013.01)

(58) Field of Classification Search
CPC ..... E02D 5/80; E04H 17/04; E04H 17/06; E04H 17/08
USPC ..... 256/1, 31–33, 35, 45, 47, 64
See application file for complete search history.

(56) References Cited

U.S. PATENT DOCUMENTS 322,172 A * 7/1885 Gates ..... E04H 17/08 256/35
377,682 A * 2/1888 Lott ..... E04H 17/08 256/35
720,025 A * 2/1903 Harbold ..... E04H 12/20 52/166
861,543 A * 7/1907 Shafer ..... 256/35 X
997,852 A * 7/1911 Rinehart ..... E02D 5/80 52/155
999,786 A * 8/1911 Heyerly ..... 256/35 X
1,321,824 A * 11/1919 Heim ..... E02D 5/80 256/35
1,828,350 A * 10/1931 Williams ..... 256/35
4,436,284 A * 3/1984 Varela-Hernandez ..... 256/35
4,825,600 A * 5/1989 Osgood, Sr. ..... A01G 13/0293 135/118
8,136,293 B2 * 3/2012 Morgan ..... E04H 17/06 47/47

FOREIGN PATENT DOCUMENTS

EP 0872178 A1 * 10/1998 ..... E04H 17/08

* cited by examiner

*Primary Examiner* — Josh Skroupa

(57) ABSTRACT

An improved fence anchor device for securing fence fabric extending along a fence structure. The fence anchor device includes an elongated stake having a tine end imbedded within the ground, and a clasp end positioned proximate the fence fabric. A tether is rotatably captured within a keeper provided in said clasp end, and the tether includes a first angled leg having a first hook end, and a second angled leg having a second hook end spaced apart at a distance that corresponds with a distance between a first fence link and a second fence link located along the fence fabric.

29 Claims, 6 Drawing Sheets

FENCE ANCHOR DEVICE

FIELD OF THE INVENTION

The present invention is directed to a fence anchor that prevents or limits movement along the bottom edge of fence fabric material in a fence structure, and in particular, it is directed to a fence anchor device that improves rigidity and resistance against transverse movement along the bottom edge of a chain-link fence fabric in a fence structure so that it is difficult to push or pull the bottom edge of the fence fabric away from the ground.

BACKGROUND OF THE INVENTION

Chain-link fence structures typically comprise a plurality of spaced apart fence posts that are imbedded in the ground along a fence line, a top rail fixed to the fence posts, and a chain-link fence fabric attached to and spanning the fence posts and top rail. Consequently, chain-link fences have long lengths of fence fabric extending between spaced apart fence posts. Such suspended fence fabric is free to sway along its bottom edge portion, and over time, the swaying fabric may become distorted and/or raised from its position proximate the ground. In addition to the swaying problem, small domestic and wild animals, such as dogs or rabbits, are able to push their way under such unsupported fence fabric lengths unless a tensioning device or other holder is used to provide rigidity along the bottom edge that prevents or at least limits transverse/vertical movement of the fence fabric material.

Various clips, stakes, and anchor devices have been used in the past to provide such rigidity in wire strand and/or fence fabric materials. These devices have been used mainly in farm applications so that it is more difficult for livestock to break through the fence and escape enclosed pens and pastures. For example, tether/stake combinations have been used to secure wire strand fencing against movement as disclosed in United States patent no. 997,852, to Rinehart. The Rinehart patent discloses a combination stake and single tether connection to hold down a fence wire and prevent the wire from being raised by animals such as hogs. A different type anchor device, comprising a stake without a tether, is disclosed in U.S. Pat. No. 1,569,341 to Varell. Varell discloses a ground stake having a pair of vertically aligned eyelets that are used to secure wires or ropes in a fence like structure. Another stake anchor device, having a single connection to a wire strand, is disclosed in U.S. Pat. No. 1,321,824 to Heim. Heim discloses an anchor comprising a bent rod placed over the bottom wire strand in a fence structure. The angled legs, formed by the bent rod, are driven into the ground with a special tool. Each angled leg includes a hook or barbed end that fixes the fence anchor in the ground and thereby limits movement of the bottom wire strand. U.S. Pat. No. 1,007,564 to Hardie discloses a clip or stay fastener comprising a rod and two vertically aligned spaced apart hooks that engage the top and bottom edges of a fence fabric. The distance between the spaced apart hooks is predetermined so that the hooks stretch the fence fabric and prevent fabric sagging. In a modified version of the Hardie device, the rod includes a pointed tip for driving the clip or stay into the ground.

Although such fence fastening devices of the past are somewhat effective in limiting transverse and/or vertical movement in fencing, fasteners of the past use either single point connections or vertically aligned multiple point connections. Such connections are somewhat problematic in that they transfer the full tension load from the anchor stake into the fence fabric and wire strands. This becomes a problem where the tension load is great enough to cause the wire strand or fabric to exceed its elastic limit, in which instance, the fencing material at and near the connection point becomes distorted. To illustrate, referring to U.S. Pat. No. 1,426,044 to Clum, FIG. 1 shows a fence anchor stake driven into the ground and distorting the fence fabric at the single connection point. Such distortion in fence fabric material may be acceptable in farm applications, but it is not acceptable in residential applications where the homeowner is careful to maintain the appearance of his/her fencing.

Additionally, fence anchor devices of the past provide either a tether/stake pin connection, (U.S. Pat. No. 1,268,459 to Hjermstad) where the tether is free to rotate or pivot about the connection, or a tether/stake moment connection (U.S. Pat. No. 1,426,044 to Clum), where the tether is fixed and not able to rotate or pivot about the connection. Pin connections and moment connections are useful under different fence anchoring conditions. For example, although prior anchor stakes are shown imbedded vertically into the ground, along a fence line, such perfect conditions seldom occur in real life. More typically, anchor stakes tend to be driven into the ground outboard of the fence line because it is difficult to place such stakes directly below the fence fabric. And more often than not, the anchor stakes are not driven into the ground vertically because they impact upon stones and other different density materials as the pointed end of the stake penetrates the ground. Consequently, because there is often misalignment between the fence anchor device and the fence fabric, it may be difficult to attach the hook ends of the tethers to selected links in the fence fabric. Pin connections overcome such problems because they are able to rotate or pivot about the tether/stake connection. However, pin connections are problematic in that they enable the fence fabric to sway, and over time, such swaying about pin connections may cause the fence fabric to distort. On the other hand, because tether/stake moment connections are fixed, and no rotation occurs between the tether and stake, it may be more difficult to insert the tether hooks into selected fence fabric links. However, such tether/stake moment connections prevent sway and are thereby desirable because they prevent or reduce fence fabric distortion.

SUMMARY OF THE INVENTION

It is therefore an object of the present invention to provide a fence anchor device that improves rigidity and resistance against transverse movement along the bottom edge of fence fabric in a fence structure so that it is more difficult to push or pull the bottom edge of the fabric away from the ground.

It is another object of the present invention to provide a fence anchor device that makes it difficult for small animals to push under the fence fabric lengths extending between fence posts in a fence structure.

It is still another object of the present invention to provide a fence anchor device that reduces tension load exerted on the fence fabric in a fence structure to alleviate fence fabric distortion.

It is still another object of the present invention to provide a fence anchor device having a tether capable of attachment to fence fabric links spaced apart along the length of a fence structure.

It is still another object of the present invention to furnish a fence anchor device that selectively provides a tether/stake pin connection or a tether/stake moment connection.

In satisfaction of the foregoing objects and advantages, the present invention provides an improved fence anchor device for securing a fence fabric comprising an elongated stake having a tine end for insertion into the ground, a clasp end and a tether rotatably captured within the clasp end of the stake. The tether includes a first angled leg having a first hook shaped end and a second angled leg having a second hook shaped end spaced apart from the first hook shaped end at a distance that corresponds to a distance between a first fabric link and a second fabric link spaced apart along the length of a fence structure.

BRIEF DESCRIPTION OF THE DRAWINGS

The above and other objects, advantages, and novel features of the present invention will become apparent from the following detailed description of the preferred embodiment of the invention illustrated in the accompanying drawings, wherein.

DETAILED DESCRIPTION OF THE PREFERRED EMBODIMENT

Figure 1:
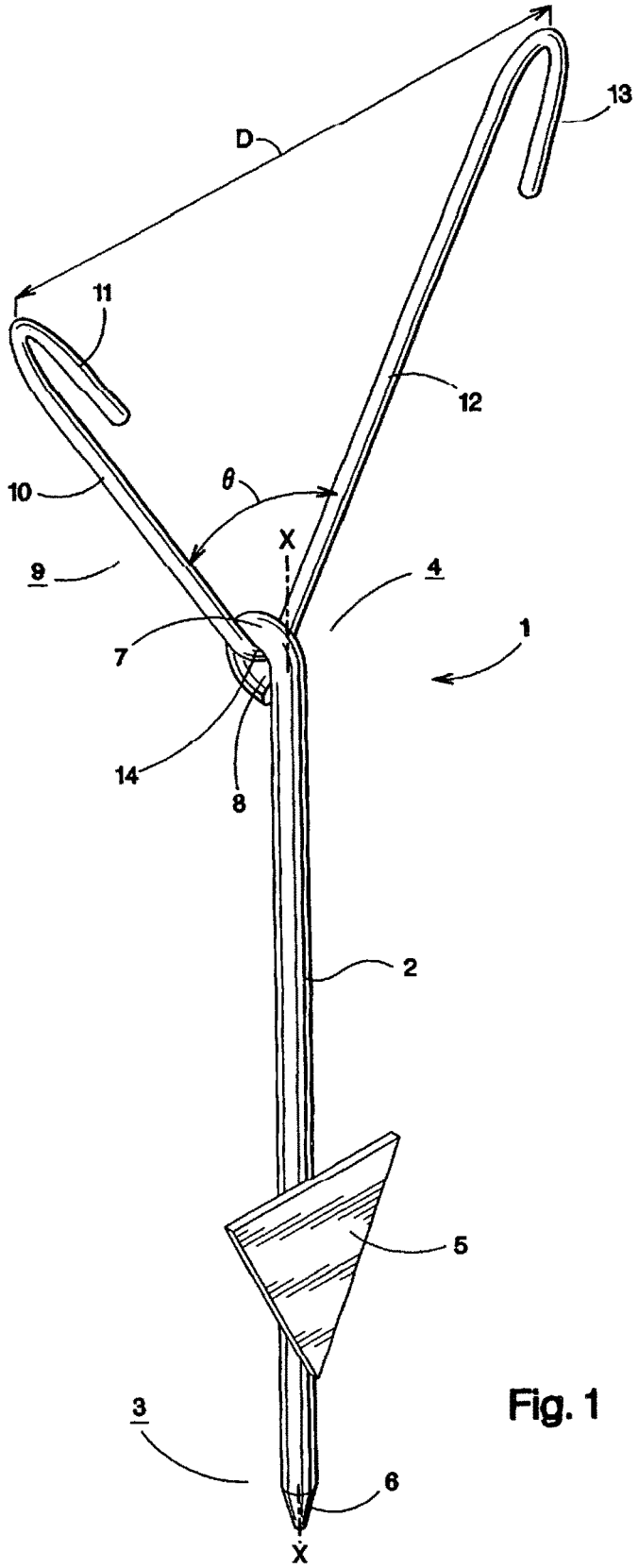
FIG. 1 is an isometric view showing the preferred fence anchor of the present invention having a tether/stake pin connection.
Figure 2:
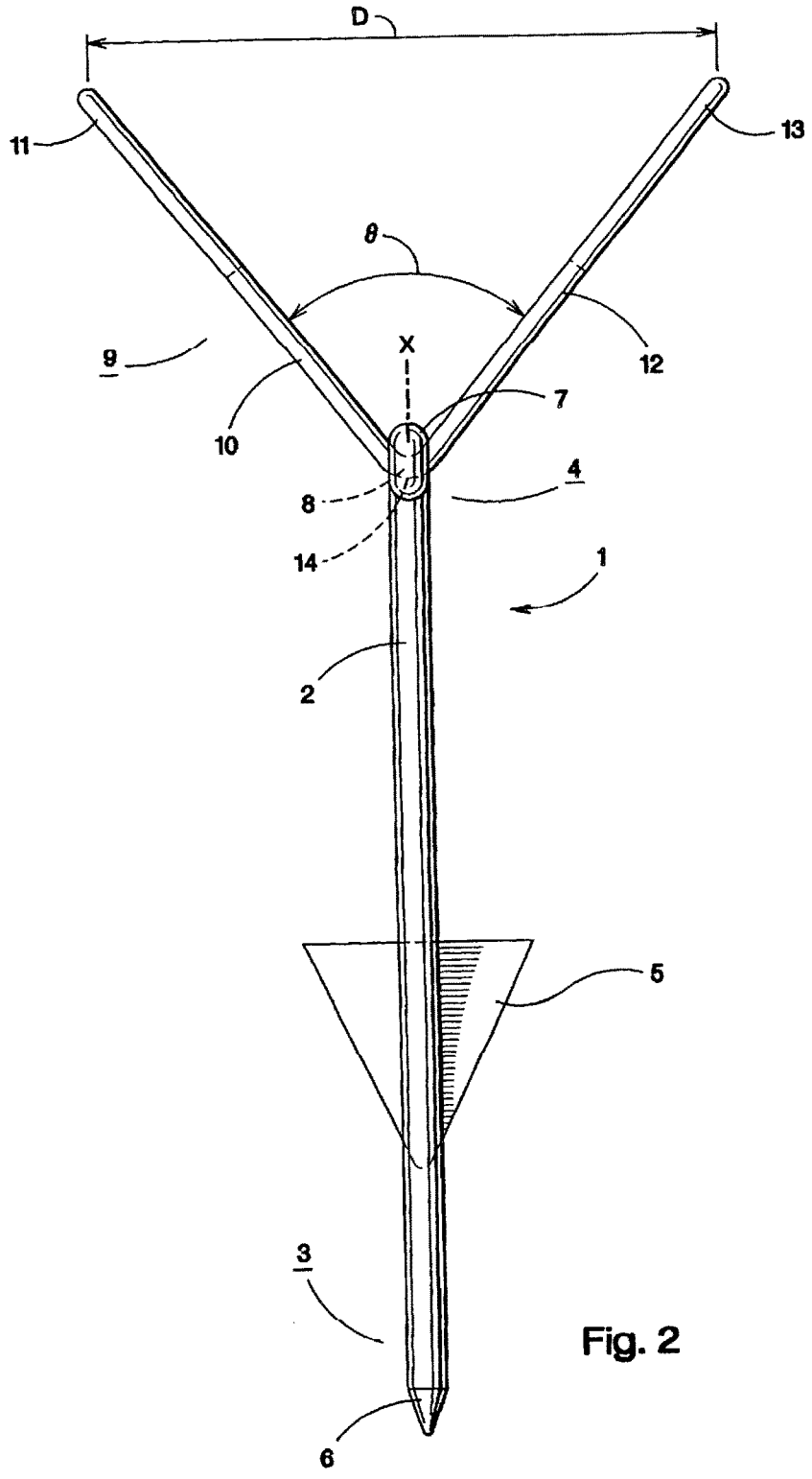
FIG. 2 is an elevation view of the fence anchor device shown in FIG. 1.

The following detailed description is directed to the preferred embodiments of the present invention. Referring to FIGS. 1 and 2 of the drawings, a fence anchor 1, adapted to secure a fence fabric to prevent transverse and vertical movement thereof, is shown comprising an elongated bar or stake 2. Stake 2 includes a tine end 3 opposite a clasp end 4, and a fluke 5 fixed to stake 2 at a location between the tine end and clasp end. Tine end 3 includes a shaped portion 6 to facilitate insertion of the bar or stake 2 into the ground, and clasp end 4 includes a roll formed portion comprising a looped keeper 7 having an opening 8 extending therethrough at an angle substantially perpendicular to a longitudinal axis X-X along stake 2.

A tether 9 extends through the opening 8, and tether 9 is rotatably captured within opening 8 so that it is able to rotate or pivot about a pin connection that fastens tether 9 and stake 2. The tether/stake pin connection facilitates attaching the tether portion of anchor 1 to lengths of fence fabric that extend between spaced apart posts in a fence structure. Tether 9 includes a first angled leg 10 having a hook end 11 and a second angled leg 12 having a hook end 13. The first and second angled legs are rotatably captured within opening 8, and the legs extend outward therefrom at an angle that corresponds with a predetermined distance D between hook end 11 and hook end 13 so that the hook ends 11 and 13 correspond with selected links spaced apart along the length of fence fabric. In the preferred embodiment, tether 9 includes a curved or arcuate segment 14 positioned between the first and second angled legs, and the curved segment 14 is rotatably captured within opening 8. Curved segment 14 prevents or limits side-to-side movement of the tether within opening 8.

Figure 3:
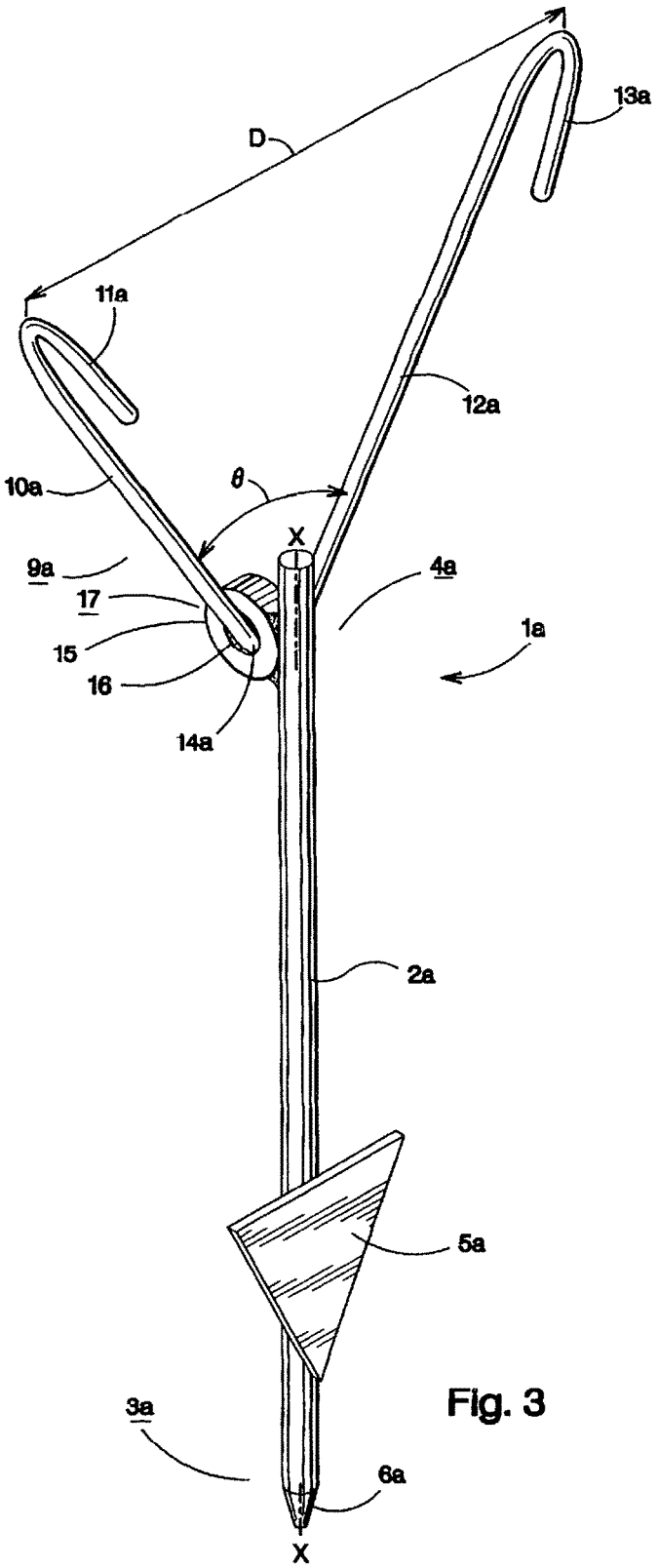
FIG. 3 is an isometric view showing the preferred fence anchor of the present invention having a tether/stake moment connection.
Figures 4, 5, 5A:
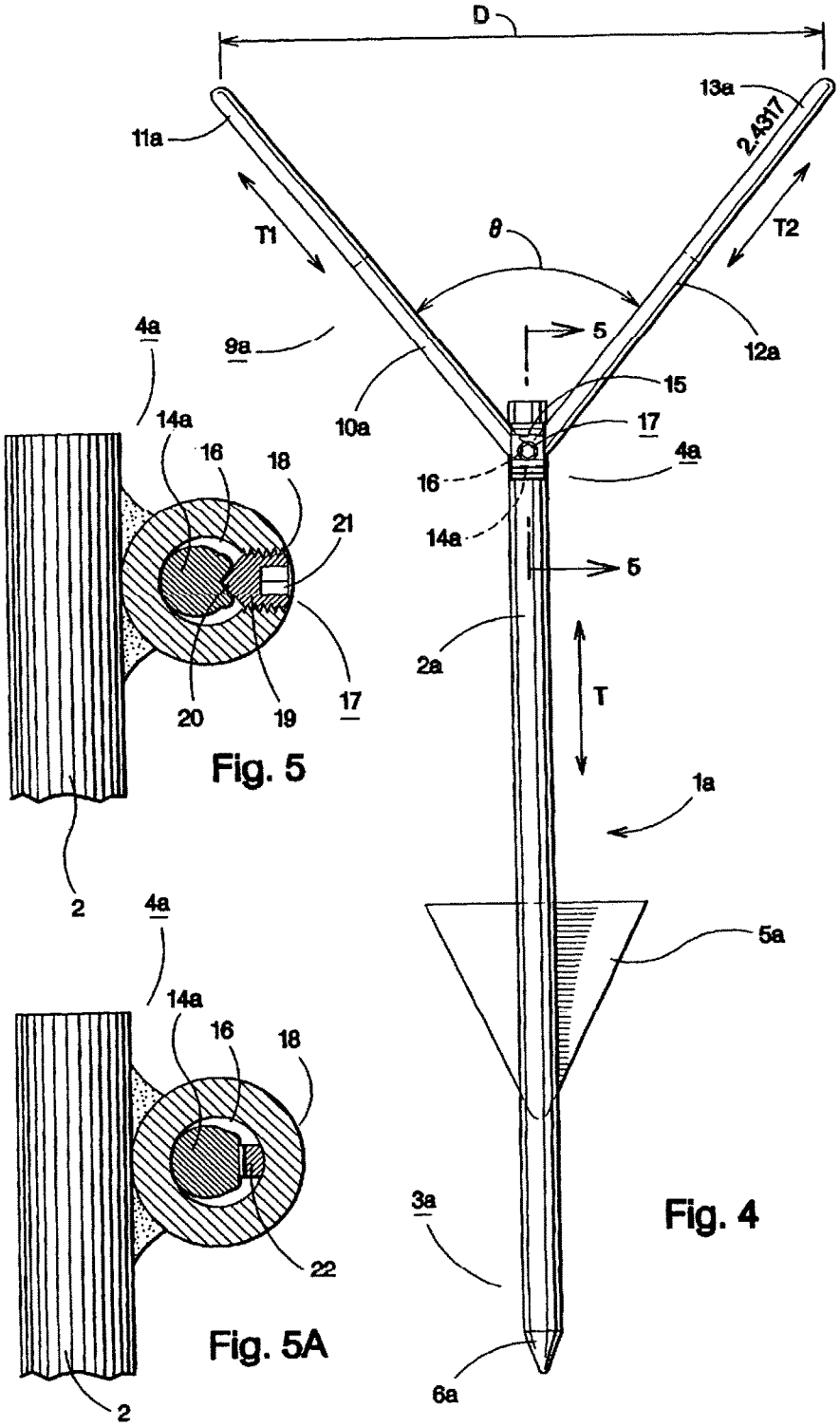
FIG. 4 is an elevation view of the fence anchor device shown in FIG. 3.
FIG. 5 is a cross-section view taken along the lines 5-5 of FIG. 4.
FIG. 5A is a cross-section view similar to FIG. 5 showing an alternate lock mechanism.

Referring to FIGS. 3 and 4, showing an alternate embodiment of the preferred fence anchor 1*a*, an elongated bar or stake 2*a* includes a tine end 3*a*, a clasp end 4*a*, and a fluke 5*a* fixed to stake 2*a* at a location between the tine end and clasp end. Tine end 3*a* includes a shaped portion 6*a* to facilitate insertion of the bar or stake 2*a* into the ground, and the clasp end 4*a* includes a keeper 15 fixed to the clasp end portion of stake 2*a* by welding or other suitable means. An opening 16 extends through keeper 15 at an angle substantially perpendicular to a longitudinal axis X-X along stake 2*a*.

Similar to the fence anchor device shown in FIGS. 1 and 2, the alternate embodiment includes a tether 9*a* having a tether portion 14*a* that extends through and is rotatably captured within keeper opening 16 to provide means for attaching fence anchor 1*a* to fence fabric in a fence structure. Tether 9*a* also includes a first angled leg 10*a* having a hook end 11*a* and a second angled leg 12*a* having a hook end 13*a*. The first and second angled legs extend outward from a tether portion 14*a* at an angle corresponding with a predetermined distance D between hook end 11*a* and hook end 13*a* so that the hook ends 11*a* and 13*a* correspond with selected fence fabric links spaced apart along the length of a fence structure.

Keeper 15 further includes a lock mechanism 17 capable of engaging or disengaging the tether portion 14*a* to enable or prevent rotation thereof. Lock mechanism 17 is selectively operated to enable or prevent rotation of tether 9*a* within keeper 15 so that when the lock mechanism is disengaged, it provides a tether/stake pin connection, and when the lock mechanism is engaged, it provides a tether/stake moment connection.

Referring to the cross-section shown in FIG. 5, lock mechanism 17 includes a threaded hole 18 extending from the outside surface of keeper 15 to opening 16. A machine screw or setscrew 19, having a tip 20 at its lead end, and a tool fitting 21 at its opposite end, is threaded into hole 18 to selectively engage tip 20 against tether portion 14*a* to prevent the tether from rotating. Similarly, machine screw 19 may be threaded outward from hole 18 to disengage tip 20 from tether portion 14*a* so that tether 9*a* may rotate. It should be understood, however, that any suitable lock mechanism may be used to control rotation of tether 9*a* without departing from the scope of the present invention. One such alternate lock mechanism example, shown in FIG. 5A, includes a wedge shaped lock member 22 driven into opening 16 to engage tether portion 14*a* and prevent tether 9*a* from rotating.

Figure 6:
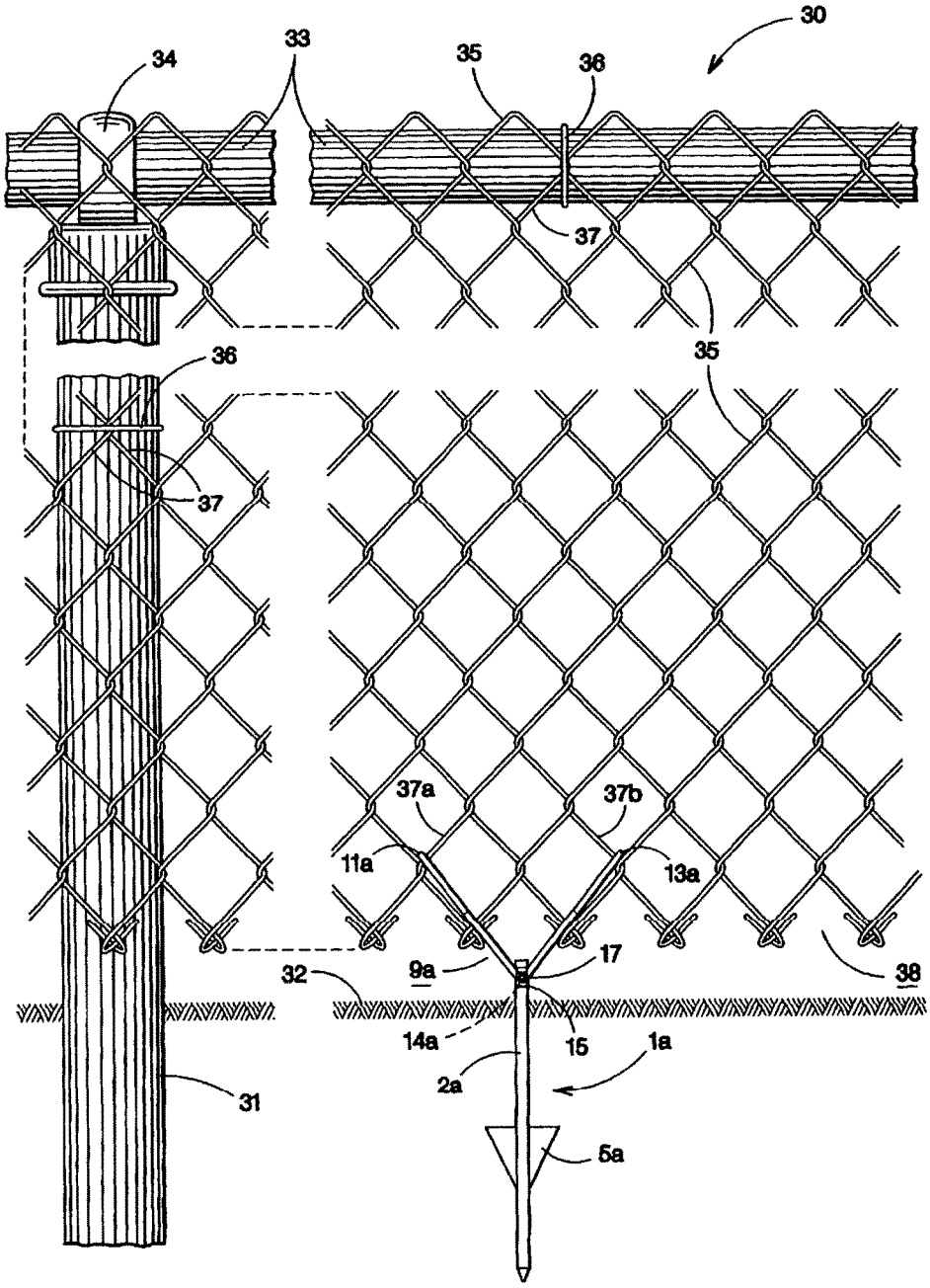
FIG. 6 is an elevation view showing the fence anchor of the present invention used to secure fence fabric in a fence structure.

Referring to FIG. 6, a chain-link fence structure 30 generally comprises a plurality of spaced apart fence posts 31 imbedded into the ground 32 along a fence line. The fence posts may be imbedded directly into the ground as shown in the drawing figure, or alternatively, imbedded into a series of concrete filled holes (not shown). A top rail 33 is fastened to the fence posts with rail support fittings 34 or the like, and a continuous fence fabric 35 spans the fence posts 31 and top rail 33. The fence fabric is fastened to the fence posts and top rail with wire grips 36 threaded through the fabric links 37 and twisted to fix the fence fabric 35 to the posts and top rail.

The bottom edge portion 38 of the continuous fence fabric material 35 is shown secured with fence anchor 1*a* of the present invention. The fence anchor prevents transverse movement along the fabric bottom edge portion 38 so that it is more difficult to push or pull the fence fabric 35 away from the ground. The stake portion 2*a* of fence anchor 1*a* is driven into the ground 32 along or proximate the fence line to a depth sufficient for the buried fluke 5*a* to hold the stake firmly in position and makes it difficult to remove the stake. In an optional embodiment, fluke 5*a* is buried to a depth greater than the frost line depth so that upward movement of stake 2*a* is prevented or retarded during freeze/thaw cycles. When stake 2*a* is driven to a satisfactory depth for attaching the tether hooks 11*a* and 13*a* to selected fence fabric links 37*a* and 37*b*, tether 9*a* is rotated or pivoted about the pin connection to engage hook ends 11*a* and 13*a* within links 37*a* and 37*b*. Stake 2*a* is then driven to a final depth within the ground. During stake driving operations, lock mechanism 17 is disengaged from tether portion 14*a* to provide a tether/stake pin connection so that the tether may adjust to any misalignment while the stake is driven into the ground. After stake 2*a* is driven to a final depth within the ground, lock mechanism 17 is operated to engage tether portion 14*a* and provide a tether/stake moment connection to prevent tether rotation about keeper 15. As mentioned above, such non-rotating moment connections improve rigidity and resistance against transverse movement along the bottom edge of a fence fabric so that it is more difficult to push or pull the bottom edge of the fence fabric away from the ground.

Referring in particular to the fence anchor 1*a* shown in FIGS. 4 and 6, as well as to the fence anchors shown in the other embodiments, tension load T, exerted by the stake 2*a* (FIG. 4), is transferred into each of the angled legs 10*a* and 12*a* respectively, and the resultant tension load T1 exerted by the first hook end 11*a* on selected link 37*a* is less than tension load T, and the resultant tension load T2 exerted by the second hook end 13*a* on selected link 37*b* is less than tension load T. Accordingly, in contrast to fence anchor devices of the past that transmit full tension load from the anchor stake to fence fabric or wire strands, the improved tether of the present invention reduces tension loading on fence fabrics and/or wire strands and thereby decreases the likelihood of fence fabric distortion.

Figure 7:
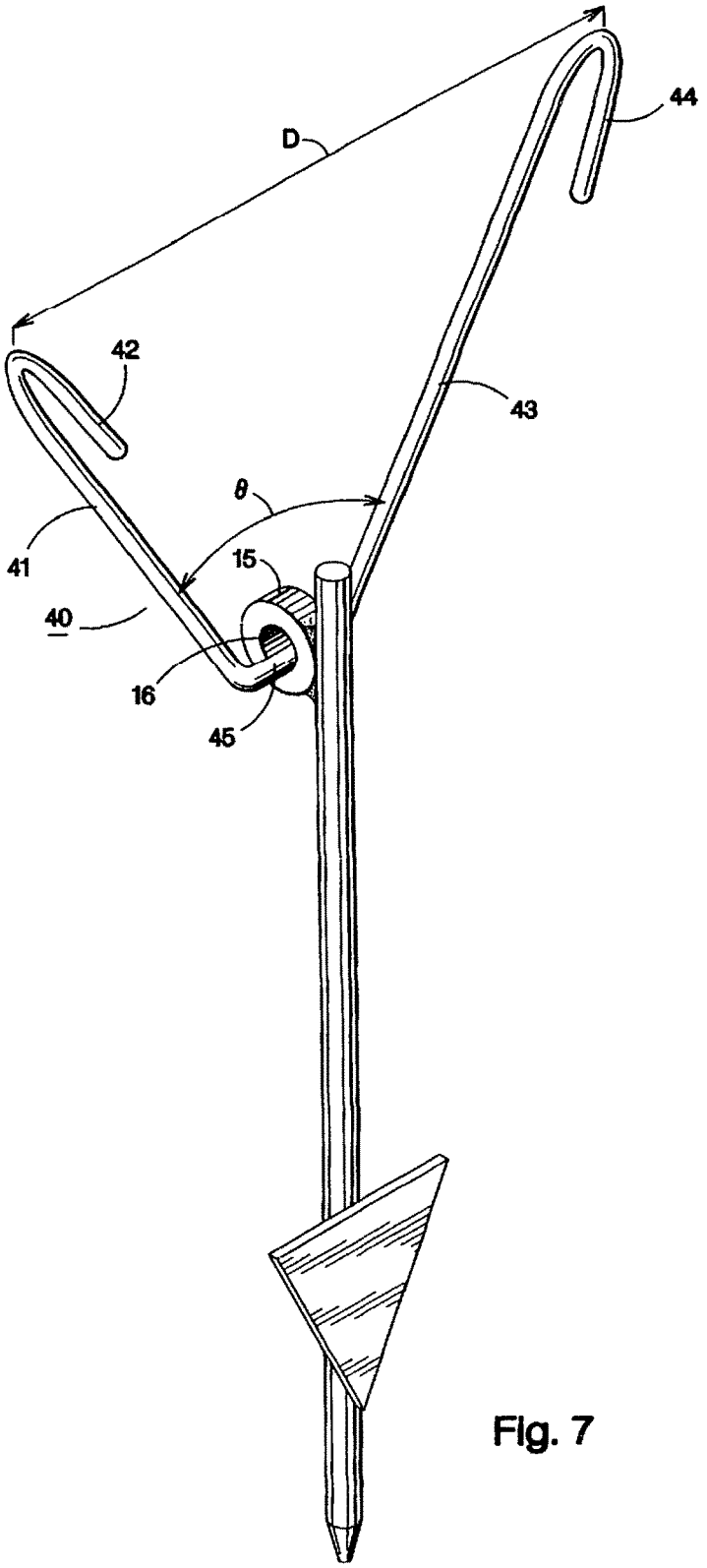
FIG. 7 is an isometric view similar to FIG. 4 showing an alternate tether embodiment.

Referring to FIG. 7, an alternate tether 40 is shown comprising a first angled leg 41 having a hook end 42, a second angled leg 43 having a hook end 44, and an elongated leg 45 extending between the first angled leg 41 and the second angled leg 43. Elongated leg 45 is rotatably and slidably captured within the opening 16 that extends through keeper 15 so that tether may be rotated about keeper 15 to engage hook ends 42 and 44 within selected fence fabric links, and also adjusted in a side-to-side longitudinal direction with respect to the fence structure so that hook ends 42 and 44 may be aligned with selected fence fabric links spaced apart along the length of the fence. Similar to the other embodiments, the first and second angled legs 41 and 43 extend outward from elongated leg 45 at an angle corresponding to a predetermined distance D between hook end 42 and hook end 44 so that the hook ends 42 and 44 correspond with selected fabric-links in the fence structure.

As such, an invention has been disclosed in terms of preferred embodiments thereof that fulfill each and every one of the objects of the present invention as set forth above. Of course, various changes, modifications, and alterations from the teachings of the present invention may be contemplated by those skilled in the art without departing from the intended spirit and scope thereof. For example, although the various embodiments show the present fence anchor invention attached to a chain-link fence fabric, the fence anchor may be attached to other fence materials without departing from the scope of this invention, such exemplary materials including wire strand fencing and mesh fabric fencing of assorted geometric shapes.

I claim:

1. A fence anchor device for securing a fence fabric to the ground between fence posts, comprising:

a) an elongated stake, said elongated stake adapted for penetrating the ground including a tine end and a clasp end;

b) a tether rotatably captured within a keeper provided in said clasp end, said tether including a first leg having a first hook end and a second leg having a second hook end spaced apart from the first hook end at a distance that corresponds with a distance between a first fence link and a second fence link spaced apart along a fence fabric the first and second legs being angled with respect to each other.

2. The invention recited in claim 1 wherein said first angled leg and said second angled leg extend outward from opposite sides of said keeper at an angle with respect to each other, said angle being predetermined so that said distance between said first hook end and said second hook end corresponds with said distance between said first fence link and said second fence link.

3. The invention recited in claim 1, comprising:

a) a curved tether segment positioned between said first angled leg and said second angled leg, said curved segment being rotatably captured within said keeper, said curved segment being shaped to prevent side-to-side movement within said keeper.

4. The invention recited in claim 3 comprising:

a) a tether leg segment positioned between said first angled leg and said second angled leg, said tether segment being rotatably captured within said keeper, said curved segment being shaped to enable side-to-side movement of said tether within said keeper.

5. The invention recited in claim 1, comprising:

a) a looped keeper formed in said clasp end of said elongated stake, said tether extending through and held within an aperture extending through said looped keeper.

6. The invention recited in claim 1, comprising:

a) a tubular keeper fixed to said clasp end of said elongated stake, said tether being rotatably captured within said tubular keeper.

7. The invention recited in claim 6, comprising:

a) a lock mechanism selectively operated to engage and disengage said tether within said aperture extending through said tubular keeper, said lock mechanism being operable to disengage from said tether to provide a tether/stake pin connection, and said lock mechanism being operable to engage said tether to provide a tether/stake moment connection.

8. The invention recited in claim 7 wherein said lock mechanism includes a set screw threaded through said tubular keeper and communicating with said aperture, said set screw positioned so that it is able to engage and disengage said tether when said set screw is rotated.

9. The invention recited in claim 1, comprising:

a) a fluke fixed to said elongated stake at a location between said tine end and said clasp end.

10. The invention recited in claim 9 wherein said fluke is fixed to said elongated stake at a distance from said clasp end greater than a frost line depth.

11. The invention recited in claim 1 wherein said tine end comprises a conically shaped surface adapted to penetrate a ground surface.

12. In a fence structure including a plurality of spaced apart posts imbedded within a section of ground extending along a fence line, a top rail fixed to the plurality of spaced apart fence posts, and a continuous fence fabric attached to and spanning the plurality of spaced apart fence posts and top rail, the improvement comprising:

a) a plurality of anchor devices spaced apart proximate the continuous fence fabric and attached thereto to restrict fence fabric movement, each of said anchor devices comprising, i) an elongated stake including a tine end imbedded within the ground proximate the fence line, and a clasp end extending upward from the ground adjacent the continuous fence fabric; and ii) a tether including a first leg having a first hook end, and a second leg having a second hook end, said tether rotatably captured within said clasp end so that said tether may be rotated within said clasp end to engage said first hook end within a first link in the continuous fence fabric, and to engage said second hook end within a second link in the continuous fence fabric.

13. The invention recited in claim 12, comprising:

a) at least one anchor device positioned between adjacent fence posts.

14. The invention recited in claim 12 wherein said first angled leg and said second angled leg extend outward from opposite sides of said keeper at an angle θ, said angle θ predetermined so that said distance between said first hook end and said second hook end corresponds with said distance between said first fence link and said second fence link.

15. The invention recited in claim 12 comprising:

a) a curved tether segment positioned between said first angled leg and said second angled leg, said curved segment rotatably captured within said keeper, said curved segment shaped to prevent side-to-side movement within said keeper.

16. The invention recited in claim 12 comprising:

a) a looped keeper formed in said clasp end of said elongated stake, said tether rotatably captured within said looped keeper.

17. The invention recited in claim 12 wherein at least one anchor device in said plurality of anchor devices includes an elongated stake, comprising:

a) a tubular keeper fixed to said clasp end of said elongated stake, said tether rotatably captured within an aperture extending through said tubular keeper.

18. The invention recited in claim 17, comprising:

a) a lock mechanism selectively operable to engage and disengage said tether within said aperture extending through said tubular keeper, said lock mechanism operated to disengage from said tether to provide a tether/stake pin connection, and said lock mechanism operated to engage said tether to provide a tether/stake moment connection.

19. The invention recited in claim 18 wherein said lock mechanism includes a set screw threaded through said tubular keeper and communicating with said aperture, said set screw threaded through said tubular keeper, said set screw positioned to engage and disengage said tether.

20. The invention recited in claim 12, wherein at least one anchor device in said plurality of anchor devices includes a tether, comprising:

a) an elongated tether leg positioned between said first angled leg and said second angled leg, said elongated tether leg rotatably captured within said keeper, said curved segment shaped to enable side-to-side movement of said tether within said keeper.

21. The invention recited in claim 12, comprising:

a) a fluke fixed to said elongated stake at a location between said tine end and said clasp end.

22. The invention recited in claim 21 wherein said fluke is fixed to said elongated stake at a distance from said clasp end greater than a frost line depth.

23. The invention recited in claim 12 wherein said tine end comprises a shaped surface adapted to penetrate a ground surface.

24. A method for securing fencing material in a fence structure to prevent movement thereof, the steps of the method comprising:

a) providing a plurality of anchor devices, each anchor device including a tine end, a clasp end, and a tether rotatably captured within said clasp end, said tether including a first leg having a first hook end, a second leg having a second hook end spaced apart from said first hook end;

b) imbedding said tine end of each anchor device within a section of ground extending along a fence line, said anchor devices spaced apart along said fence line so that each said clasp end extends upward from the ground and at a position proximate the fencing material;

c) rotating each said tether within said clasp end so that said first hook end and said second hook end engage the fencing material at a spaced apart distance along the fence structure; and d) imbedding each said anchor device to a final depth within the ground so that said first engaged hook end and said second engaged hook end apply a tension load to the fencing material.

25. The method recited in claim 24, step (a) further comprising:

a) providing in said plurality of anchor devices, at least one anchor device including a tether locking mechanism adapted to fix said tether within said clasp end and prevent rotation thereof.

26. The method recited in claim 25, further comprising:

a) imbedding said at least one anchor device including a tether locking mechanism to a final depth within the ground; and b) operating said tether locking mechanism to fix said tether within said clasp end so that said first engaged hook end and said second engaged hook end apply a substantially uniform tension load to the fencing material.

27. The method recited in claim 24 wherein the fencing material is a wire strand.

28. The method recited in claim 24 wherein the fencing material is a mesh fabric.

29. The method recited in claim 24 wherein the fencing material is a chain-link fence fabric.

* * * * *